United States Patent [19]

Shuster et al.

[11] 3,996,170

[45] Dec. 7, 1976

[54] 6-n-BUTYL ALPHA PYRONE PERFUMES

[75] Inventors: Edward J. Shuster, Brooklyn, N.Y.; Alan Owen Pittet, Atlantic Highlands, N.J.

[73] Assignee: International Flavors & Fragrances Inc., New York, N.Y.

[22] Filed: Sept. 17, 1975

[21] Appl. No.: 614,081

Related U.S. Application Data

[63] Continuation-in-part of Ser. No. 471,755, May 20, 1974, abandoned.

[52] U.S. Cl. ..... 252/522

[51] Int. Cl.[2] ..... C11B 9/00

[58] Field of Search ..... 252/522

[56] References Cited

OTHER PUBLICATIONS

M. R. Sevenants et al., J. Food Science, 36 (3) p. 536, 1971.

Steffen Arctander, Perfume and Flavor Chemicals (Aroma Chemicals) Published by the Author, Montclair, N.J., 1969 pp. 1347; 2230; 2781; 3024; 3025.

*Primary Examiner*—Veronica O'Keefe

*Attorney, Agent, or Firm*—Arthur L. Liberman; Harold Haidt; Franklin D. Wolffe

[57] ABSTRACT

Perfume and fragrance compositions, and perfumed articles comprising one or more 6-alkyl-alpha-pyrones having the generic structure:

wherein $R_1$ is methyl or hydrogen and $R_2$ is $C_3$-$C_5$ alkyl, and processes for preparing same are described.

5 Claims, 1 Drawing Figure

6-n-BUTYL ALPHA PYRONE PERFUMES

BACKGROUND OF THE INVENTION

Figure 1:
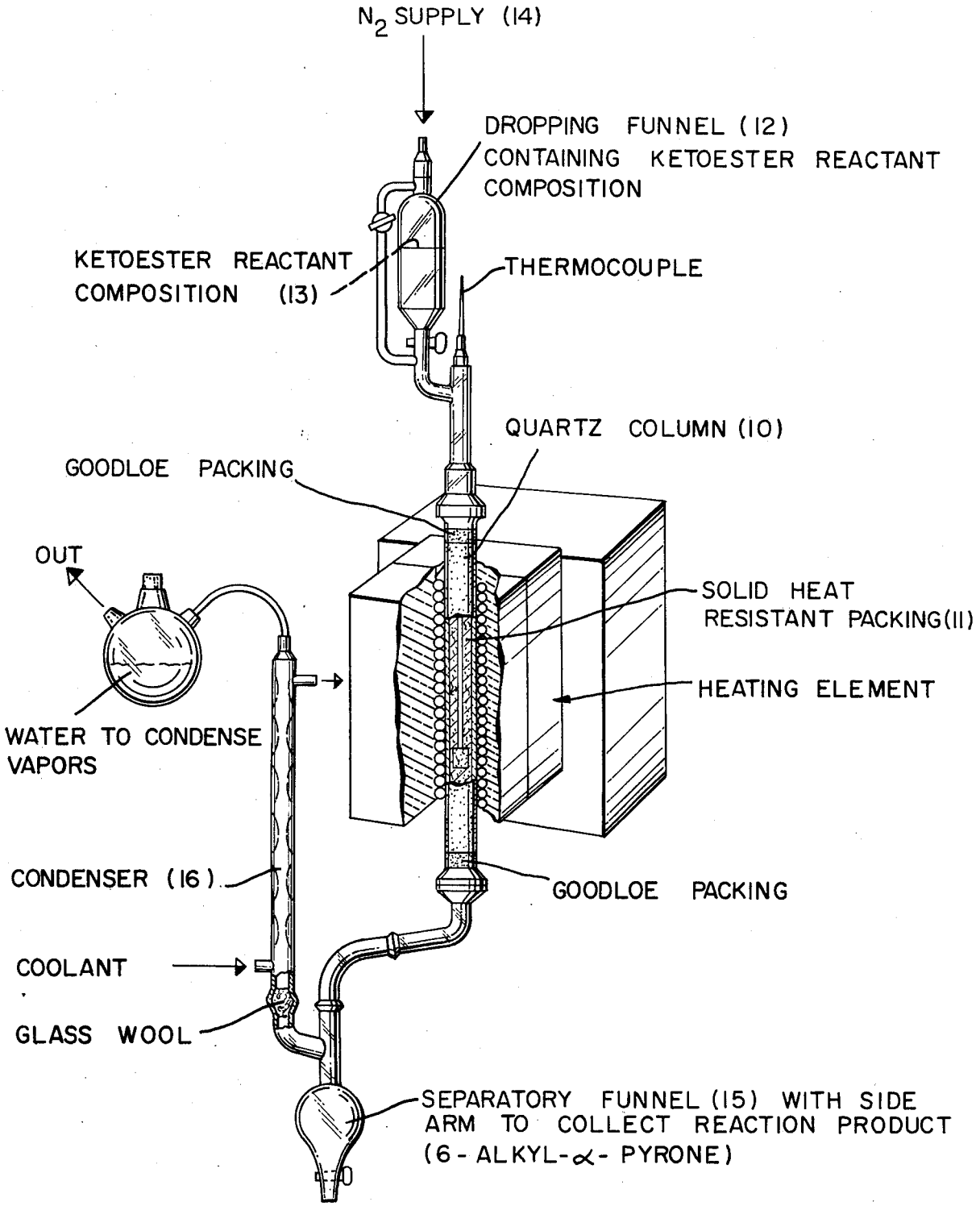

There is a continuing search for materials having desirable fragrance properties. Such materials are sought either to replace costly natural materials or to provide new fragrances or perfume types which have not heretofore been available. Especially desirable qualities for substances having interesting fragrances are stability and persistence in a wide variety of perfumed articles and perfume compositions, ease of manufacture, and intensity of aroma.

Sweet, coumarin-like, herbal, floral, coconut, green, lovage, celery, tagette, and foenugreek-like notes are particularly desirable for many uses in conjunction with perfumes and perfumed compositions and articles.

Various alpha pyrones have been described as being useful in altering the organoleptic characteristics of flavors for foodstuffs as well as fragrances for use in conjunction with perfumed articles.

Arctander, *Perfume and Flavor Chemicals* (*Aroma Chemicals*) 1969 contains the following teachings:

i. At No. 1347, the flavor and perfume use of 5-ethyl-alpha pyrone;

ii. At No. 2230, the flavor and perfume use of 5-methyl-alpha pyrone;

iii. At No. 2781, the perfume use of alpha pyrone.

Taylor et al. British Pat. No. 748,645, discloses at page 7, lines 105 and 106 the use in butter flavors of the lactones of unsaturated delta hydroxy acids. Sevenants, *J. Food Sci.*, 1971, 36 (3), 536 discloses the occurence of 6-pentyl-alpha-pyrone in peach aroma. Nobuhara, *Agr. Biol. Chem*, 1969, 33, No. 9, 1264-9 (Title: "Synthesis of Unsaturated Lactones/III: Flavorous Nature of Some delta-Lactones having the Double Bond at Various Sites") indicates the waxey, butter-cake flavor of 6-pentyl-alpha-pyrone at page 1267, col. 1. In addition, the flavor attributes of alpha-pyrones, in general are discussed by Nobuhara.

Methods for the preparation of the alpha pyrones found to be useful in our invention are disclosed as follows:

i. Lohaus et al., Chemische Berichte, 100, 658 (1967);

ii. Wiley et al., *J. Org.Chem.*, 22, 1257–9 (1957);

iii. Belgian Pat. No. 643,891, Aug. 17, 1964;

iv. Nobuhara, Agr. Biol. Chem. 1969, 33 (9), 1264–9;

v. Pettit et al., J. Org. Chem., 1970, 35 (5), 1398–1404;

vi. Lamberti et al., Recueil, 86, (1967) 504–510;

The 6-alkyl-alpha pyrones of our invention, which are unsubstituted at the "4" position of the pyrone ring may also be prepared according to the process of copending U.S. application for Letters Patent Ser. No. 471,756 filed on May 20, 1974, now U.S. Pat. No. 3,873,574, the reactions of which are as follows.

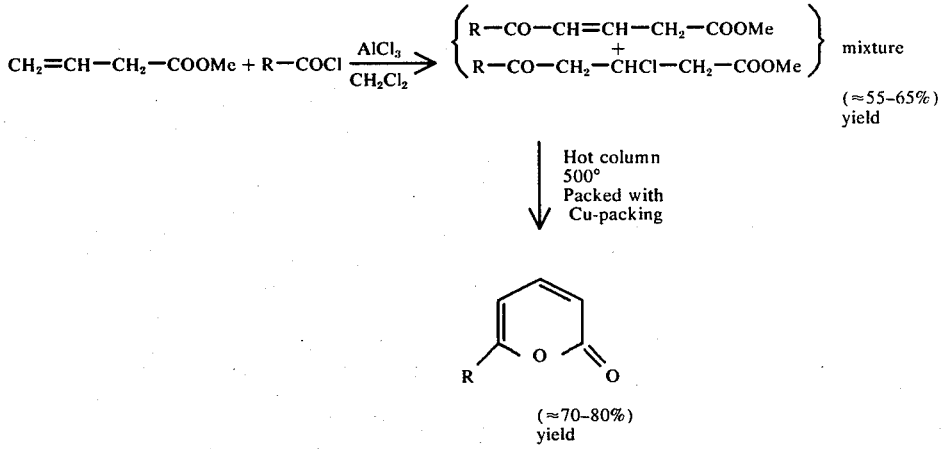

wherein R is alkyl.

THE INVENTION

It has now been discovered that perfume formulations, perfumed materials and perfumed articles having one or more of sweet, coumarin-like, herbal, floral, green, lovage, coconut, celery, tagette and/or foenugreek notes may be provided by adding one or more 6-alkyl-alpha pyrones having the structure:

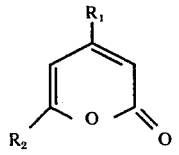

wherein $R_1$ is methyl or hydrogen and $R_2$ is $C_3$–$C_5$ alkyl, to perfume and fragrance-modifying materials or to materials to be fragranced (e.g., soaps or detergents).

It has been found that the 6-alkyl-alpha pyrones of this invention possess one or more of sweet, coumarin-like, herbal, floral, coconut, green, lovage, celery, tagette and/or foenugreek notes with good intensity and persistence. This fragrance quality particularly adapts the 6-alkyl-alpha pyrones for incorporation into perfume compositions and fragrance-modifying compositions having desirable "Spicy Floral" or "Woody-Aphrodesia" aromas. It will be appreciated by those skilled in the art from the present disclosure that the fragrance character of the finished perfume compositions can be tailored to specific uses; as more fully described hereinafter.

Specific examples of the 6-alkyl-alpha pyrone compounds contemplated within the scope of our invention and their fragrance properties are as follows:

| Compound | Fragrance Properties |
|---|---|
| 4-methyl-6-n-butyl- | Sweet, coumarin-like, |

-continued

| Compound | Fragrance Properties |
|---|---|
| alpha-pyrone | lovage, foenugreek, celery notes. |
| 4-methyl-6-n-pentyl-alpha-pyrone | Long lasting celery, lovage, tagette notes. |
| 4-methyl-6-i-propyl-alpha-pyrone | Sweet, rum-like, lovage, tagette aroma with tonka undertone. |
| 6-n-propyl-alpha-pyrone | Creamy, sweet, coumarin, herbal note. |
| 6-n-butyl-alpha-pyrone | Sweet, floral, slight coumarin character. |
| 6-n-pentyl-alpha-pyrone | Intense, green, floral and coconut aroma. |

The 6-alkyl-alpha-pyrones are olfactory agents and can be incorporated into a wide variety of compositions which will be enhanced by any of the sweet, coumarin-like, herbal, floral, coconut, green, lovage, celery, tagette and/or foenugreek notes. The 6-alkyl-alpha-pyrones can be added to perfume compositions in their pure forms or they can be added to mixtures of materials in fragrance-imparting compositions to provide a desired fragrance character to a finished perfume material. The perfume and fragrance compositions obtained according to this invention are suitable in a wide variety of perfumed articles and can also be used to enhance, modify or reinforce natural fragrance materials. It will thus be appreciated that the 6-alkyl-alpha-pyrones of this invention are useful as olfactory agents and fragrances.

The term "perfume composition" is used herein to mean a mixture of compounds, including, for example, natural oils, synthetic oils, alcohols, aldehydes, ketones, esters, lactones, and frequently hydrocarbons which are admixed so that the combined odors of the individual components produce a pleasant or desired fragrance. Such perfume compositions usually contain (a) the main note or the "bouquet" or foundation-stone of the composition; (b) modifiers which round-off and accompany the main note; (c) fixatives which include odorous substances which lend a particular note to the perfume throughout all stages of evaporation, and substances which retard evaporation; and (d) top-notes which are usually low-boiling fresh-smelling materials. Such perfume compositions of this invention can be used in conjunction with carriers, vehicles, solvents, dispersants, emulsifiers, surface-active agents, aerosol propellants, and the like.

In perfume compositions the individual components contribute their particular olfactory characteristics, but the overall effect of the perfume composition will be the sum of the effect of each ingredient. Thus, the 6-alkyl-alpha-pyrones of this invention can be used alone or in combination to alter the aroma characteristics of a perfume composition, for example, by highlighting or moderating the olfactory reaction contributed by another ingredient of the composition.

The amount of 6-alkyl-alpha-pyrone of this invention which will be effective in perfume compositions depends on many factors, including the other ingredients, their amounts and the effects which are desired. It has been found that perfume compositions containing as much as 50% or as little as 0.4% by weight of mixtures or compounds of this invention, or even less can be used to impart one or more of sweet, coumarin-like, herbal, floral, coconut, green, celery, lovage, tagette and/or foenugreek aromas to soaps, cosmetics, and other products. The amount employed will depend on considerations of cost, nature of the end product, the effect desired in the finished product, and the particular fragrance sought.

The 6-alkyl-alpha-pyrones disclosed herein can be used alone in a fragrance-modifying composition, or in a perfume composition as olfactory components in detergents and soaps, space deodorants; perfumes; colognes; bath preparations such as bath oil, bath salts; hair preparations such as lacquers, brilliantines, pomades, and shampoos; cosmetic preparations such as creams, deodorants hand lotions, sun screens; powders such as talcs, dusting powders, face powder and the like. When the 6-alkyl-alpha pyrones of this invention are used in perfumed articles such as the foregoing, they can be used individually or in combination in amounts of 0.1% or lower. Generally, it is preferred not to use more than about 10% in the finished perfumed article, since the use of too much will tend to unbalance the total aroma and will needlessly raise the cost of the article.

The following examples serve to illustrate embodiments of the invention as it is now preferred to practice it. It will be understood that these examples are illustrative and the invention is to be considered restricted thereto only as indicated in the appended claims.

EXAMPLE I

SPICY FLORAL PERFUME FORMULATION

The following mixture is prepared:

| Ingredient | Parts by Weight |
|---|---|
| Bergamot Oil | 50 |
| Coumarin | 60 |
| Cinnamic Alcohol | 40 |
| Indol | 1 |
| Patchouli Oil | 20 |
| Musk Ketone | 40 |
| 3-Norbornyl cyclohexanol | 5 |
| Lavender Barreme | 30 |
| Amyl Salicylate | 80 |
| 4-(4-methyl, 4-hydroxyamyl)$\Delta^{3}$-cyclohexene carboxaldehyde | 40 |
| Vanillin | 2 |
| Benzyl Salicylate | 80 |
| Jasmin Absolute | 3 |
| Ylang, Extra | 20 |
| Eugenol | 80 |
| Linalyl Acetate | 50 |
| Phenyl Ethyl Alcohol | 20 |
| Mixture containing primarily methyl-2,6,10-trimethyl-2,5,9-dodecatrien-1-yl ketone, produced according to the process of Example I of Canadian Patent 864,592 | 60 |
| Orange Oil | 5 |
| 4-methyl-6-n-butyl-alpha-pyrone | 5 (0.71% of formulation) |

The 4-methyl-6-n-butyl-alpha-pyrone imparts a lovage, foenugreek character to this Spicy Floral perfume formulation.

EXAMPLE II

WOODY, APHRODESIA PERFUME FORMULATION

The following mixture is prepared:

| Ingredient | Parts by Weight |
|---|---|
| Vanillin | 2 |
| Myrrh Coeur | 3 |
| Olibanum Coeur | 3 |

EXAMPLE II-continued

WOODY, APHRODESIA PERFUME FORMULATION

The following mixture is prepared:

| Ingredient | Parts by Weight | |
|---|---|---|
| Resin Absolute Labdanum | 3 | |
| Methyl ester of 3,6-dimethyl resorcylic acid | 5 | |
| Mixture containing primarily methyl-2,6,10-trimethyl-2,5,9-dodecatrien-1-yl-ketone, produced according to the process of Example I of Canadian Patent 864,592 | 50 | |
| Cedryl Methyl ether having the structure | 79 | |
| 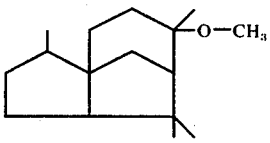 | | |
| 4-(4-methyl, 4-hydroxyamyl)$\Delta^3$-cyclohexene carboxaldehyde | 20 | |
| Ylang Extra | 5 | |
| p-t-butyl cyclohexyl acetate (27% "cis" isomer) | 30 | |
| Indol | 1 | |
| Gamma Methyl Ionone | 35 | |
| Jasmine Absolute | 5 | |
| Rose Absolute | 3 | |
| Eugenol | 15 | |
| Isoeugenol | 10 | |
| 3-Norbornyl-cyclohexanol | 10 | |
| 6-oxa-1,1,2,3,3,8-hexamethyl-2,3,5,6,7,8-hexahydro-1H-Benz(f)indene | 50 | |
| 6-n-butyl-alpha-pyrone | 15 | (6.7% of formulation) |
| 6-n-pentyl-alpha-pyrone | 5 | |

The 6-n-butyl-alpha-pyrone imparts a floral, sweet character to this wood, aphrodesia perfume formulation. The 6-n-pentyl-alpha-pyrone imparts a green, coconut, tobacco note to this woody, aphrodesia perfume formulation.

EXAMPLE III

PREPARATION OF SOAP COMPOSITION

One hundred grams of soap chips are mixed with one gram of the perfume composition of Example I until a substantially homogeneous composition is obtained. The perfumed soap composition manifests an excellent spicy floral character with lovage, foenugreek notes.

EXAMPLE IV

PREPARATION OF A DETERGENT COMPOSITION

A total of 100 grams of a detergent powder is mixed with 0.15 grams of the perfume composition of Example I until a substantially homogeneous composition is obtained. This composition has an excellent spicy floral odor with a lovage, foenugreek note.

EXAMPLE V

PREPARATION OF A COSMETIC POWDER COMPOSITION

A cosmetic powder is prepared by mixing in a ball mill 100 grams of talcum powder with 0.25 grams of 4-methyl-6-n-butyl-alpha-pyrone. It has an excellent lovage, foenugreek aroma.

EXAMPLE VI

PERFUMED LIQUID DETERGENT

Concentrated liquid detergents with a lovage, foenugreek odor are prepared containing 0.10%, 0.15% and 0.20% of 4-methyl-6-n-butyl-alpha-pyrone. They are prepared by adding and homogeneously mixing the appropriate quantity of 4-methyl-6-n-butyl-alpha-pyrone in the liquid detergent. The detergents all possess a lovage, foenugreek fragrance, the intensity increasing with greater concentration of 4-methyl-6-n-butyl-alpha-pyrone.

EXAMPLE VII

PREPARATION OF A COLOGNE AND HANDKERCHIEF PERFUME

4-Methyl-6-n-butyl-alpha-pyrone is incorporated in a cologne at a concentration of 2.5% in 85% aqueous ethanol; and into a handkerchief perfume at a concentration of 20% (in 95% aqueous ethanol). A distinct and definite strong lovage, foenugreek fragrance is imparted to the cologne and to the handkerchief perfume.

EXAMPLE VIII

The composition of Example I is incorporated in a cologne at a concentration of 2.5% in 85% aqueous ethanol; and into a handkerchief perfume at a concentration of 20% (in 95% aqueous ethanol). The use of the 4-methyl-6-n-butyl-alpha pyrone in the composition of Example I affords a distinct and definite strong spicy floral perfume aroma having a lovage, foenugreek note to the handkerchief perfume and cologne.

EXAMPLE IX

PREPARATION OF SOAP COMPOSITION

One hundred grams of soap chips are mixed with 1 gram of the perfume composition of Example II until a substantially homogeneous composition is obtained. The perfumed soap composition manifests an excellent woody, aphrodesia character with floral, sweet, green, coconut and tobacco notes.

EXAMPLE X

PREPARATION OF A DETERGENT COMPOSITION

A total of 100 grams of a detergent powder is mixed with 0.15 grams of the perfume composition of Example II until a substantially homogeneous composition is obtained. This composition has an excellent woody, aphrodesia odor with floral, sweet, green, coconut, and tobacco notes.

EXAMPLE XI

PREPARATION OF A COSMETIC POWDER COMPOSITION

A cosmetic powder is prepared by mixing in a ball mill 100 grams of talcum powder with 0.25 grams of 6-n-butyl-alpha-pyrone. It has an excellent floral, sweet character. The same cosmetic powder is then further admixed in a ball mill with 0.25 grams of 6-n-pentyl-alpha-pyrone. The cosmetic powder now has an excellent, green, floral, sweet, coconut, tobacco fragrance.

EXAMPLE XII

PERFUMED LIQUID DETERGENT

Concentrated liquid detergents with green, coconut, tobacco fragrances are prepared containing 0.10%, 0.15% and 0.20% of 6-n-pentyl-alpha-pyrone. They are prepared by adding and homogeneously mixing the appropriate quantity of 6-n-pentyl-alpha-pyrone in the liquid detergent. The detergents all possess a green, coconut, tobacco fragrance, the intensity increasing with greater concentration of 6-n-pentyl-alpha-pyrone.

EXAMPLE XIII

PREPARATION OF A COLOGNE AND HANDKERCHIEF PERFUME 6-n-butyl alpha-pyrone is incorporated in a cologne at a concentration of 2.5% in 85% aqueous ethanol; and into a handkerchief perfume at a concentration of 20% (in 95% aqueous ethanol). A distinct, lasting and definite strong sweet, floral fragrance is imparted to the cologne and to the handkerchief perfume.

EXAMPLE XIV

PREPARATION OF A COLOGNE AND A HANDKERCHIEF PERFUME

The composition of Example II is incorporated in a cologne at a concentration of 2.5% in 85% aqueous ethanol; and into a handkerchief perfume at a concentration of 20% (in 95% aqueous ethanol). The use of the composition of Example II affords a distinct, long lasting and definite woody, aphrodesia aroma having sweet, green, floral, coconut and tobacco notes to the handkerchief perfume and to the cologne.

EXAMPLE XV

A. SYNTHESIS OF 6-n-PROPYL-ALPHA-PHYRONE ACCORDING TO THE REACTION

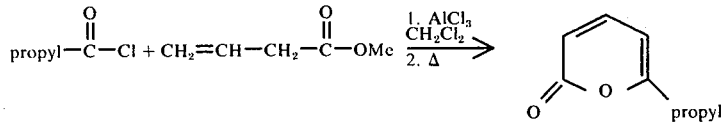

To a stirred suspension 68 g of aluminum chloride in 150 cc dichloromethane at room temperature, a mixture of 25 g of methyl-3-butenoate and 40.5 g. of butanoyl chloride is added during a period of 30 minutes while maintaining the reaction temperature at 20°–25° C with external cooling. The resulting solution is solution is refluxed for a period of 2.5 hours. The resulting brown reaction product is then decomposed by pouring same into excess ice-water mixture. The organic layer is collected and the aqueous phase is extracted with two (2) 250 cc portions of diethyl ether. The combined organic layers are then washed with saturated salt solution and dried over anhydrous magnesium sulfate. The solvent is then evaporated and the residual oil weighing 82.5 g is diluted to a volume of 150 cc with cyclohexane and placed in the dropping funnel (Reference number 12 in FIG. 1).

The resulting solution is passed dropwise through a Quartz column (Reference number 10 in FIG. 1) packed with 0.24 inches of protruded copper packing (Reference number 11 in FIG. 1), in the apparatus as set forth in Exhibit 1 heated to 500° C over a period of approximately 90 minutes. The reaction product, recovered in separatory funnel (Reference number 15 in FIG. 1) using a Buchi evaporator (10 mm Hg/75° C) and then the resulting residue is distilled under reduced pressure employing a short path column. NMR, GLC, IR and mass spectral analyses confirm that the resultant material is n-propyl-alpha-pyrone.

Analyses: MS: m/e (%) 95(100), 39(90), 81(47), 27(35), M138(28), 110(23); IR: $cm^{-1}$ ≈1740 and ≈1725 split C=O absorptions ≈1635 and ≈1555 C=C stretching bands.

NMR: ppm proton assignment
a. 0.94
b. 1.71
c. 2.44
d. 5.97
e. 6.09
f. 7.22

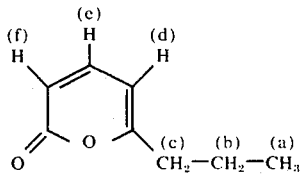

b.p. 110°/2.0 mm

B. SYNTHESIS OF 6-i BUTYL-ALPHA-PYRONE-ACCORDING TO THE REACTION

C. SYNTHESIS OF 4-METHYL-6-BUTYL-α-PYRONE ACCORDING TO THE REACTION:

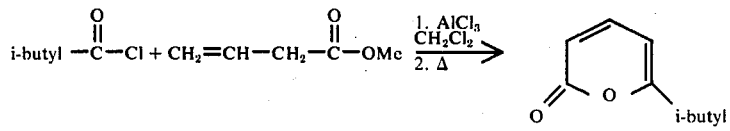

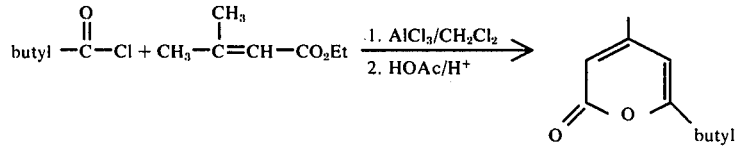

To a stirred suspension of 67 g of aluminum chloride in 150 cc dichloromethane at room temperature, a mixture of 25 g of methyl-3-butenoate and 30.5 g of pentanoyl chloride is adding during a period of 30 minutes while maintaining the reaction temperature at 20°–25° C with external cooling. The resulting solution is refluxed for a period of 2.5 hours. The resulting brown reaction product is then decomposed by pouring same into excess ice-water mixture. The organic layer is collected and the aqueous phase is extracted with two (2) 250 cc portions of diethyl ether. The combined organic layers are then washed with saturated salt solution and dried over anhydrous magnesium sulfate. The solvent is then evaporated and the residual oil weighing 82.5 g is diluted to a volume of 150 cc with cyclohexane and placed in the dropping funnel (Reference numeral 12 in FIG. 1).

The resulting solution is passed dropwise through a Quartz column (Reference number 10 in FIG. 1) packed with 0.24 inches copper packing (Reference numeral 11 in FIG. 1). in the apparatus as set forth in Exhibit 1 heated to 500° C over a period of approximately 90 minutes. The reaction product, recovered in separately funnel (Reference number 15 in FIG. 1) is then evaporated using a Buchi evaporator (10 mm Hg./75° C) and then the resulting residue is distilled under reduced pressure employing a short path column. NMR, GLC, IR and mass spectral analyses confirm that the resultant material is 6-i-butyl-α-pyrone.

Analyses: MS: m/e (%) 39(100), 95(81), 110(70), 81(39), 27(35), M152 (33); IR: $cm^{-1}$ ≈1740 and ≈1725 split C=O absorptions ≈1635 and ≈1555 C=C stretching bands.

NMR: ppm proton assignment
a. = b. 0.92
c. 2.08
d. 2.31
e. 5.94
f. 6.05
g. 7.24

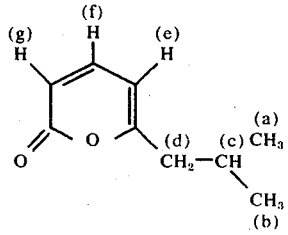

b.p. 85–87°/2.0–2.5 mm

Chemicals 250 cc dichloromethane
267 g (2 moles aluminum chloride)
134 g (1 moles pentanoyl chloride)
128 g (1 moles ethyl 3-methyl-2-butenoate)

Equipment

Two liter reaction flask equipped with stirrer, thermometer, reflux condenser, dropping funnel, wet-ice cooling bath and heating mantle.

Procedure:

The equipment is purged with nitrogen and 250 cc dichloromethane and 267 g aluminum chloride are placed in the flask. To this stirred slurry, over a period of 45 minutes, a mixture of 134 g pentanoyl chloride and 128 g ethyl 3-methyl-2-butenoate is added. The temperature is maintained at approximately 25° with cooling. After the addition is complete, the resulting solution is refluxed for two hours. The reaction mixture is the cooled, poured into an excess of a crushed ice-water. The extracted product is with two 250 cc portions of hexane. The combined extract is washed with a 400 cc saturated salt solution, dried with magnesium sulfate and the solvent is evaporated on a Buchi evaporator. The residual oil (204 g) is rushed over at 100°–140°/1–2 mm, employing a short path column, to yield 195 g yellow colored oil. In a 500 cc round-bottom flask equipped with reflux condenser is placed 300 cc acetic acid, 10 cc concentrated sulfuric acid and 97.5 g intermediate. This mixture is refluxed for 30 minutes. The solution is cooled and poured into an ice-water mixture. The product is extracted with two 250 cc hexane portions and the combined extract is dried with magnesium sulfate. The solvent is then evaporated on a Buchi evaporator. The residual oil (90g) is rushed over at 105°–135°/1–3 mm using a short path column. The yield of yellow oil is 77.7 g. The oil is fractionally distilled using a micro Vigreux column after adding 20g Primol[R] yielding the following fractions:

| No. | Vapor Temp. (° C) | Liquid Temp. (° C) | Volt | Vacuum mm/Hg | Weight (g) |
|---|---|---|---|---|---|
| 1 | 55/100 | 120/121 | 40 | 1.0 | 1.1 |
| 2 | 103 | 123 | 40 | 1.0 | 3.2 |
| 3 | 104 | 125 | 42 | 1.0 | 3.1 |
| 4 | 104 | 125 | 42 | 0.8 | 13.2 |
| 5 | 104 | 126 | 42 | 0.8 | 21.3 |
| 6 | 105 | 127 | 42 | 0.8 | 22.4 |
| 7 | 105 | 134 | 42 | 0.8 | 6.8 |
| 8 | 105 | 155 | 42 | 0.8 | 4.0 |
| 9 | 108 | 175 | 50 | 0.8 | 0.8 |

Residue: 1 g
Fr. 3–8 = 70.8 g pale yellow oil
Yield = 78%

Analyses: MS: m/e (%) 109(100), 53(92), 95(85), 27(78), 29(47), 138(47), M 166(46); IR: $cm^{-1}$ 1730 (broad) C=O stretching 1640 and 1560 C=C stretching.

NMR: ppm proton assignment
a. 0.89
c. = b. 1.16–1.76
d. 2.09
e. 2.42
g. = f. 5.83

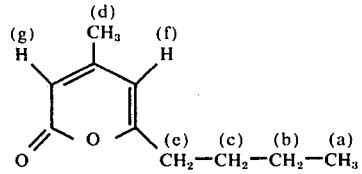

b.p. 107°/1.3 mm and the manner of testing and the test results are as follows:

The odor of the following α-pyrones are compared to delta-undecalactone; neat, in perfume formulations, in soap per se and in perfume formulations in soap:

i. 6-propyl-α-pyrone, having a green floral coconutty odor:
ii. 6-i-butyl-α-pyrone, having a sweet floral coumarinic odor;
iii. 4-methyl-6-butyl-α-pyrone, having a sweet, coumarin fragrant odor; and
iv. delta-undecalactone, having a very waxy fruity (peach) aroma.

Neat

The above α-pyrones are at least *twice* as strong as the delta-undecalactone and have more esthetic value for perfumery.

Soap Per Se

At a rate of 0.5% the test chemical is added to 150 g of Lever soap base chips (LVU-1) with constant stirring followed by 5 ml of water. Stirring is continued for approximately 10 minutes. The blended soap is then extruded and prepared at 20,000 psi in a dye. Two soap bases each are produced; one for room temperature, and the other for oven testing.

All of the above α-pyrones as well as the delta-undecalactone are incorporated into soaps at 0.5% One bar is left at room temperature (22.2° C.) and the other placed in an oven at 43.3° C. for one week after which time the soaps are evaluated.

The α-pyrones tested are found to be quite stable in soap both at room temperature and at the elevated temperature (43.3° C). In both cases the soaps containing the α-pyrones are strong and most importantly cover the soap base well.

On the other hand, the soaps containing 0.5% delta-undecalactone have very weak aromas. At room temperature the soap base odor could be detected over that of the delta-undecalactone; after a week at 43.3° C. the odor of the soap base is quite evident.

Perfume Formulation

The subject α-pyrones as well as delta-undecalactones are incorporated into a "Spicy Floral" type perfume according to the formula:

| Ingredients | I | II | III | IV |
|---|---|---|---|---|
| Coumarin | 50 | 50 | 50 | 50 |
| Musk Ambrette | 80 | 80 | 80 | 80 |
| Amyl Salicylate | 30 | 30 | 30 | 30 |
| Benzyl Salicylate | 97 | 97 | 97 | 97 |
| Bergamot Oil | 67 | 67 | 67 | 67 |
| Hydroxycitronellal | 50 | 50 | 50 | 50 |
| Lavandin Oil | 67 | 67 | 67 | 67 |
| Patchouli Oil | 12 | 12 | 12 | 12 |
| Phenyl Ethyl Alcohol | 40 | 40 | 40 | 40 |
| Gamma Methyl Ionone | 12 | 12 | 12 | 12 |
| Vetivert Oil Bourbon | 70 | 70 | 70 | 70 |
| Melysflor** | 140 | 140 | 140 | 140 |
| Benzyl Acetate | 122 | 122 | 122 | 122 |
| Linalool Syntehtic | 61 | 61 | 61 | 61 |
| Amyl Cinnamic Aldehyde | 85 | 85 | 85 | 85 |
| Indol 10% | 12 | 12 | 12 | 12 |
| Delta undecalactone | 5 | — | — | — |
| 6-propyl-alpha-pyron | — | 5 | — | — |
| 6-i-butyl-alpha-pyrone | — | — | 5 | — |
| 4-methyl-6-butyl-alpha-pyrone | — | — | — | 5 |

**Produced by Firmenich et Cie, S.A. of Geneva, Switzerland and New York, N.Y.

The addition of 0.5% 6-alkyl substituted alpha-pyrone to the perfume formulation improves the character greatly. This addition makes the perfume aroma closer to the "Spicy Floral" character. However, the addition of 0.5% delta undecalactone fails to improve the odor.

The perfume formulations containing the alpha-pyrones (Formulae II–IV) when incorporated at 1.0% into soap and left at room temperature and in the oven for one week are much warmer and fuller in odor and more characteristic of "Spicy Floral" types fragrances than the soap with 1% of the fragrance containing delta undecalctone (Formula 1).

From the above experiments it is concluded that the alpha-pyrones contribute much more of a pleasing sweet floral lactonic character to perfume compositions than does delta undecalactone which appears to contribute little. The alpha-pyrones therefore, are considered more suitable for use in perfumery.

What is claimed is:

1. A process for preparing a perfume composition comprising the step of admixing (i) a composition of matter in the liquid phase which composition of matter has an aroma impression which is capable of being modified so that it will include one or more sweet, coumarin-like, herbal, floral, green, lovage, celery, tagette and/or foenugreek notes with (ii) from about 0.4 up to 50% by weight of said composition of a synthetically produced, substantially pure 6-alkyl-alpha-pyrone, being selected from the group consisting of:

4-methyl-6-n-butyl-alpha-pyrone; and 6-n-butyl-alpha-pyrone.

2. The process of claim 1 wherein the 6-alkyl-alpha-pyrone is 4-methyl-6-n-butyl-alpha-pyrone.

3. The process of claim 1 wherein the 6-alkyl-alpha-pyrone is 6-n-butyl-alpha-pyrone.

4. A perfume composition consisting essentially of from about 0.4 up to 50% by weight of said composition of a synthetically produced, substantially pure 6-alkyl-alpha-pyrone selected from the group consisting of:

4-methyl-6-n-butyl-alpha-pyrone; and 6-n-butyl-alpha-pyrone, the remainder of said composition being one or more adjuvants selected from the group consisting of natural oils, synthetic oils, alcohols, aldehydes, ketones, esters, lactones and hydrocarbons.

5. A cologne consisting essentially of 2.5% by weight of a synthetically produced, substantially pure 6-alkyl-alpha-pyrone selected from the group consisting of:

4-methyl-6-n-butyl-alpha-pyrone; and 6-n-butyl-alpha-pyrone, the remainder of said cologne being ethanol and water, the weight ratio of ethanol:water being 85:15.

* * * * *

UNITED STATES PATENT AND TRADEMARK OFFICE

CERTIFICATE OF CORRECTION

PATENT NO. : 3,996,170

DATED : December 7, 1976

INVENTOR(S) : Edward J. Shuster and Alan Owen Pittet

It is certified that error appears in the above-identified patent and that said Letters Patent are hereby corrected as shown below:

Column 10, line 3, the equation at top of page should be in column 9, line 3.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*